US008800408B2

(12) United States Patent
Ermenault

(10) Patent No.: US 8,800,408 B2
(45) Date of Patent: Aug. 12, 2014

(54) TOOL SYSTEM FOR THE EXTRACTION OF WATCH BEZELS

(75) Inventor: Olivier Ermenault, Yverdon-les-Bains (CH)

(73) Assignee: Omega S.A., Bienne (CH)

( * ) Notice: Subject to any disclaimer, the term of this patent is extended or adjusted under 35 U.S.C. 154(b) by 605 days.

(21) Appl. No.: 13/105,547

(22) Filed: May 11, 2011

(65) Prior Publication Data

US 2011/0277596 A1 Nov. 17, 2011

(30) Foreign Application Priority Data

May 11, 2010 (CH) ..... 732/10

(51) Int. Cl.
*B25F 1/00* (2006.01)
*G04D 3/00* (2006.01)

(52) U.S. Cl.
USPC ..... 81/6; 7/100

(58) Field of Classification Search
USPC ..... 81/6; 7/100
See application file for complete search history.

(56) References Cited

U.S. PATENT DOCUMENTS

| | | | | | |
|---|---|---|---|---|---|
| 2,595,172 | A | * | 4/1952 | Schenke | 368/294 |
| 3,052,906 | A | * | 9/1962 | Shiffman | 15/105 |
| 3,074,156 | A | * | 1/1963 | Hinrichsen et al. | 29/807 |
| 3,145,459 | A | * | 8/1964 | Shiffman | 29/807 |
| 3,445,913 | A | * | 5/1969 | Piquerez | 29/807 |
| 3,898,897 | A | * | 8/1975 | Jauhiainen | 81/114 |
| 5,355,571 | A | * | 10/1994 | Miche | 29/426.1 |

FOREIGN PATENT DOCUMENTS

| | | |
|---|---|---|
| CH | 609524 A | 3/1979 |
| GB | 1 102 432 | 2/1968 |

* cited by examiner

*Primary Examiner* — David B Thomas
*Assistant Examiner* — Danny Hong
(74) *Attorney, Agent, or Firm* — Griffin & Szipl, P.C.

(57) ABSTRACT

The invention includes a tool system for extracting watch bezels, including a holding body arranged for cooperating with an expansion and retraction mechanism for operating a bell-chuck which is arranged to rest on the periphery of a bezel mounted on the middle part of a watch. The tool system includes thrust means, coaxially mounted inside the bell-chuck and arranged to rest on a crystal driven into the middle part, to exert on the crystal a sufficient thrust force to cause a relative displacement of the bell-chuck relative to the crystal.

12 Claims, 2 Drawing Sheets

P
L
D1
D2
R1
R2
α
β
γ
150B
150X
150Y
158
152

TOOL SYSTEM FOR THE EXTRACTION OF WATCH BEZELS

This application claims priority from Swiss Patent application No 00732/10 filed May 11, 2010, the entire disclosure of which is incorporated herein by reference.

FIELD OF THE INVENTION

The invention concerns a tool system for the extraction of a watch bezel, including a holding body that acts as a support for an expansion or retraction mechanism for a bell-chuck, which is arranged to rest on the periphery of a bezel mounted on the middle part of a watch, and wherein said holding body is arranged to cooperate with said mechanism to operate said bell-chuck.

The invention concerns the field of watch-making tool sets, notably the field of tool sets for dismantling watches, and in particular for the extraction of bezels.

STATE OF THE PRIOR ART

Detaching the bezel and middle part is always a delicate operation, which requires experienced know-how to avoid damaging the two parts.

Few tool sets exist for carrying through this delicate operation. A tool system is known from CH Patent No. 609 524 in the name of Rolex SA including two knives simultaneously inserted between the two parts to be separated. However, this tool system cannot guarantee that the parts will be perfectly intact after being disconnected, since the knives are sharp and mark the bezel. Other tool sets of the hub-puller type are also known, particularly for extracting crystals, as in GB Patent No. 1 102 432 in the name of Piquerez SA Ervin, but the peripheral support can mark the sides of the parts and, moreover, improper handling can severely damage them, notably by throwing the bezel off-centre, which the user cannot notice. The few devices available on the market have wedges, generally two or three, on which a helical cut support member presses. During the thrust, the support member alternately presses on one or other of the wedges, and the thrust therefore inevitably has radial and axial components. The inherent risk of this slanting thrust is that the bezel is forced out sideways and damaged.

These commercially available tool sets are generally made of steel, manufactured in a similar manner to a 3 jaw-mandrel with concentric grip, and are expensive precision mechanical units. Special jaw sets have to be used according to the bezel size, which increases the purchase price, but also the operating cost because of the time spent changing jaws.

SUMMARY OF THE INVENTION

The invention proposes to make available to users, usually after-sales services and watch repairers, a tool system for the extraction of a bezel that can guarantee perfect axial removal of the bezel, which is versatile and especially which ensures that the components handled remain perfectly intact. The desired tool system must be inexpensive and very quick and simple to use.

The invention therefore concerns a tool system for the extraction of a watch bezel, including a holding body arranged to cooperate with an expansion or retraction mechanism for operating a bell-chuck, which is arranged to rest on the periphery of a bezel mounted on the middle part of a watch, characterized in that it includes thrust means, mounted coaxially inside said bell-chuck and arranged to rest on a crystal driven into said middle part, and to exert a sufficient thrust force on said crystal to cause a relative displacement of said bell chuck relative to said crystal.

The invention also concerns a bell-chuck arranged to be used in a tool system according to the invention.

The invention also concerns the unit formed by a tool system according to the invention and a bell-chuck of this type.

DESCRIPTION OF THE DRAWINGS

The invention will be become clearer upon reading the following description, with reference to the annexed drawings, in which.

DETAILED DESCRIPTION OF THE INVENTION

Figures 1, 2, 3, 4, 5:
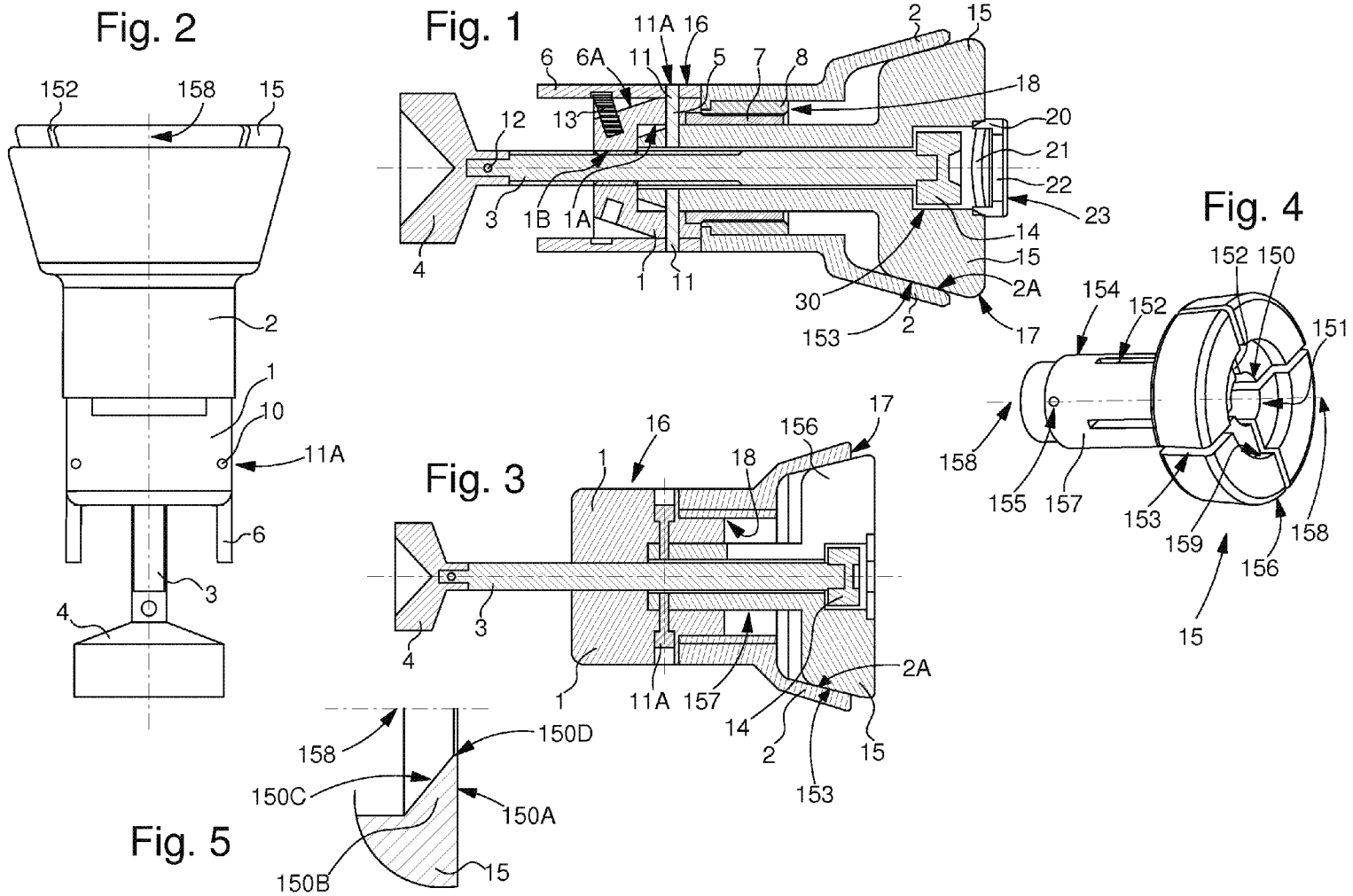
FIG. 1 shows schematically a longitudinal cross-section of a tool system according to the invention, in a first embodiment.
FIG. 2 shows schematically an elevation view of the tool system of FIG. 1.
FIG. 3 shows schematically a longitudinal cross-section of a tool system according to the invention, in another embodiment.
FIG. 4 shows schematically a perspective view of the bell-chuck arranged to be used in a tool system according to the invention.
FIG. 5 shows schematically a longitudinal cross-section of the detail of the lips of the bell-chuck.

The invention concerns the field of watch-making tool sets, notably the field of tool sets for dismantling watches, and in particular for the extraction of bezels.

The invention concerns a tool system 100 for the extraction of a watch bezel.

This bezel 20 is mounted, in a conventional manner, generally driven onto a middle part 22 of a watch 23. This watch 23 further includes a crystal 21 driven into middle part 22.

Tool system 100 includes a holding body 16, which acts as a support for an expansion or retraction mechanism 17 of a bell-chuck 15, which is arranged to rest on the periphery of a bezel 20.

The invention also concerns a bell-chuck 15, arranged to be used in a tool system according to the invention.

This bell-chuck 15, as seen in FIG. 4, includes a head 156 and a foot 157, which are preferably coaxial about an axis 158. Head 156 is arranged to receive the bezel 20 in a recess 150, which includes a front support surface 151, perpendicular to axis 158, and a lateral holding surface 159 arranged to rest on the periphery of bezel 20. This lateral holding surface 159 has a variable geometry. Bell-chuck 15 is of the split collet type, and includes one or several slots 152 which allow the radial retraction or expansion of head 156 according to the effort applied to an external peripheral surface 153 of said head 156. This peripheral surface 153 is preferably conical, but could very well adopt a different tapered profile whose radius increases with the distance travelled along axis 158.

As seen in FIG. 5, bell-chuck 15 also includes, at the front end 150A thereof, at housing 150, lips 150B, which have rotational symmetry relative to an axis of revolution about which an external conical profile of bell-chuck 15 develops, arranged to cooperate with an internal conical profile 2A of a bell 2, inside which the bell-chuck is inserted in the operating position. Preferably, edges 150D at the free end of lips 150B are coplanar, and arranged to separate bezel 20 from middle part 22. These lips 150B are pointed towards axis 158; the section thereof is preferably substantially triangular, for example with an angle of 40° between the front end 150A and a tapered face 150C. The radial development of these lips 150B is on the order of 0.5 mm, the smallest section thereof at edge 150D forming the pointed end is on the order of several hundredths of a millimeter, for example 6 hundredths of a millimeter. The different edges 150D are at least two in number and they are concentric.

It is clear that, in the absence of any stress on the peripheral surface 153, the slot or slots 152 are completely open, and head 156 then has its maximum spatial requirement, as does peripheral holding surface 159. It is then possible, with the assembled tool system 100, to cover bezel 20, holding said bezel in frontal abutment on support surface 151 and/or positioning edges 150D for insertion at the join between bezel 20 and middle part 22 of the watch. When bell-chuck 15 is designed for a particular watch model, the dimensioning of housing 150 both allows the bezel to be held with front support on support surface 151 and lips 150B, and more particularly edges 150D, to be precisely positioned facing the join between bezel 20 and middle part 22 of the watch.

The user can then exert a peripheral force on peripheral surface 153 to close slot(s) 152. The support exerted by edges 150D remains concentric relative to axis 158 and, because they are fine, lips 150B can be slightly deformed while ensuring that edges 150D have a circular shape, which avoids damaging both bezel 20 and middle part 22, and engages edges 150D between said two elements like an encircling wedge. Closing slot(s) 152 allows the jaws formed by head 156 to close around bezel 20 until a grip is obtained on peripheral holding surface 159. Bezel 20 is then held perfectly axially and radially and can be handled relative to middle part 22 for the purpose of being permanently extracted therefrom.

The foot 157 of bell-chuck 15 includes means 154 for guiding inside tool system 100, which is more particularly arranged for cooperating with complementary guide means 1A comprised in base 1 forming holding body 16 or integrated therein. Preferably, this guide means 154 is cylindrical and complementary means 1A is formed by a bore. This foot 157 further includes stop means 155, which is arranged to cooperate with complementary stop means comprised in holding body 16 or base 1, for immobilising bell-chuck 15 axially relative to said base.

Figures 6, 7, 8, 9, 10, 11, 12, 13, 14:
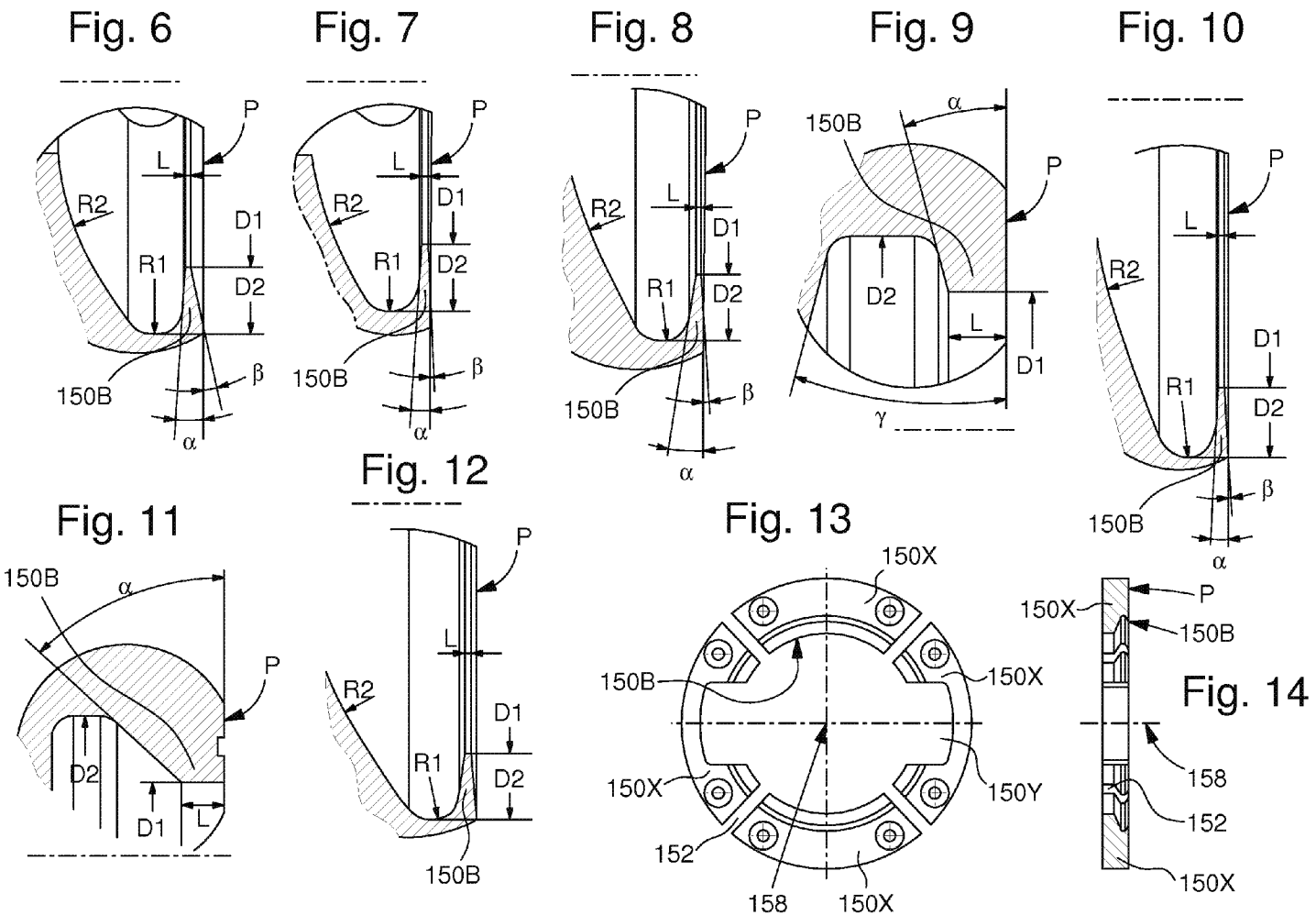
FIGS. 6 to 12 show different examples of profiles of the lips of bell-chucks according to the invention.
FIG. 13 is a front view of a bell-chuck insert including the lips of FIG. 8.
FIG. 14 is a longitudinal cross-section of the insert of FIG. 13.

In an alternative embodiment, as seen in FIGS. 13 and 14, lips 150B are one or several inserts 150X mounted in or on the body of bell-chuck 15. To avoid any jamming, these inserts are advantageously made of brass or a similar material, chosen to avoid marking a gold middle part. An insert of this type can be devised in the form of an annular circlip or even in the form of ring sectors 150X secured to the bell-chuck, particularly by screws, as seen in FIGS. 13 and 14.

The number of and distribution of slots 152 are chosen so as to best distribute the force when the bezel is separated from the middle part. The best results are obtained with four slots that are symmetrical relative both to the axis of the horns and to the axis passing through the centre and perpendicular to said axis. Some inserts 150× then have a recess 150Y for the horns to pass through.

It is clear that each type of bezel 20 involves the use of a bell-chuck 15 of particular dimensions. Indeed, in order to preserve the concentric gripping precision of the chuck and thus ensure the integrity of bezel 20 when handled, the gripping range must be sufficiently restricted, since otherwise play and eccentricity phenomena occur, which are counter to the desired result. Bell-chucks 15 are therefore interchangeable.

Advantageously, bell-chucks 15 are made of a plastic material such as "Delrin®>> or similar.

FIGS. 6 to 12 show various examples of lip profiles of the bell-chucks according to the invention, which differ depending upon the types of watches for which they are intended. These views include:

- the width L of edge 150D of lip 150B;
- the re-entrant angle β formed by a first surface of lip 150B with a frontal plane P;
- the angle α formed by a second surface of lip 150B separated from the first surface by edge 150D with the same frontal plane P;
- the diameter D1 corresponding to edge 150D, which is preferably, but not necessarily, parallel to axis 158 of bell-chuck 15;
- the diameter D2 of the enlarged bottom after the second surface;
- the enlarged radius R1 at this diameter D2;
- the radius R2 made by the inner profile of bell-chuck 15, after radius R1, or
- the angle γ made by the inner profile of bell-chuck 15 after this recess.

The corresponding numerical values (in millimeters and degrees) are:

FIG. 6: D1=27; D2=29.3; L=0.1; α=3; β=11; R1=0.5; R2=6;

FIG. 7: D1=24; D2=26.3; L=0.1; α=4; β=4; R1=0.5; R2=6.2;

FIG. 8: D1=34.8; D2=37.1; L=0.1; α=8; β=4; R1=0.5; R2=13;

FIG. 9: D1=43.5; D2=45.5; L=1; α=15; β=0; γ=15;

FIG. 10: D1=37.8; D2=40.1; L=0.1; α=4; β=4; R1=0.5; R2=13.5;

FIG. 11: D1=41.5; D2=43.9; L=0.75; α=45; β=0; R1=0.4; R2=0.4; γ=0;

FIG. 12: D1=40.8; D2=43.1; L=0.1; α=8; β=4; R1=0.5; R2=10.

These values are in no way limiting, and the proportions thereof correspond to numerous cases in common use.

Also, in a preferred manner, the complementary stop means of holding body 16 or base 1 is mobile to allow bell-chuck 15 to be exchanged for a different bell-chuck, depending upon the type of bezel to be extracted. In the example of FIG. 1, the complementary stop means is formed by pins 11 which can move substantially radially in housings in holding body 16 or base 1. Advantageously, these pins 11 are manoeuvrable via pivoting parts 6 jointed on pivots 11A on holding body 16 or base 1 and moveable in housings 6A of holding body 16 or base 1, and these pins 11 are returned to an retracted position by springs 13 acting on pivoting elements 6. In the example of FIG. 3, the complementary stop means of base 1 is formed by radial screws 11A in housings of base 1.

Holding body 16 may be formed of a base 1 and an external insert 7 in an embodiment forming the subject of FIG. 1. It may also be a single piece base 1 in another embodiment which is the subject of FIG. 2. These embodiments are merely non-restrictive examples of the invention.

The expansion and retraction mechanism 17 of bell-chuck 15 includes longitudinal operating means 18 for a bell 2. This bell 2 cooperates via the inner profile 2A thereof with the peripheral surface 153 of bell-chuck 15, to open or close the latter. Preferably, when the peripheral surface 153 of bell-chuck 15 is conical, this inner profile 2A is also conical, with the same conicity. As it moves longitudinally, bell 2 thus exerts pressure more or less strongly on bell-chuck 15. Preferably, the longitudinal operating means 18 results from the cooperation between an external and internal thread, notably in the case of FIG. 1, the external thread of an external insert 7 integral with holding body 16 or base 1, and the internal thread of an internal insert 8 integral with bell 2. In the other embodiment of FIG. 3, the external thread is made on base 1 and the internal thread is made in bell 2. By rotating bell 2 relative to holding body 16, it is thus possible to generate a controlled variation in the grip of bell-chuck 15. The smaller the thread pitch the finer this variation will be. Bell 2 is advantageously made of an aluminium alloy or similar.

The user is thus certain that bezel 20 will be properly held, without being damaged, and, owing to the front support surface 151, the geometry of tool system 100 is properly set opposite bezel 20, with axis 158 properly perpendicular to the plane of the joint between bezel 20 and middle part 22.

According to the invention, tool system 100 includes, mounted coaxially inside bell-chuck 15, thrust means 30, which is arranged to press on a crystal 21 driven into middle part 22 and to exert on said crystal 21 a sufficient thrust force to cause a relative displacement of bell-chuck 15, which has previously been placed in position holding and gripping bezel 20 relative to said crystal 21.

Preferably, this thrust means 30 includes a support member 14 arranged to rest on crystal 21. This support member 14 has a recessed area towards the centre thereof, to avoid resting on the dome of the crystal, but on a circle of large diameter, so as to best distribute the thrust force. Preferably, holding body 16 and in particular base 1 includes an internal thread 1B, which cooperates with the threaded part of an arbour 3, at a first end of which support member 14 is mounted. This arbour 3 may advantageously be a threaded stem, as shown in FIGS. 1 and 3. The second end of this arbour 3 is provided with an operating handle 4, for exerting a thrust force on crystal 21, and which, when set in rotation, causes the translation of support member 14. The smaller the thread, the finer the translation will be. Naturally, support member 14 can be interchangeable to adapt to the shape or size of crystal 21, and may notably be secured by a pin, screw or similar element to the end of arbour 3.

The tool system 100 thereby made is easy to implement and does not require combined movements, since it is operated in sequence: first of all placed in a supporting position, then bezel 21 is gripped in bell-chuck 15 by screwing or unscrewing bell 2 relative to base 1, then support member 14 is placed so as to rest on crystal 21 by rotating handle 4, and then thrust onto crystal 21 by continued rotation of this handle 4.

The tool system is operated very precisely and respects the watch and the components thereof.

The tool system is moderately priced, compact and perfectly responds to the requirements of a reparation or after-sales service.

The invention also concerns the unit formed by a tool system according to the invention and a bell-chuck of this type.

In short, the invention proposes a precise tool system, devised to protect the middle part and bezel of the watch during dismantling and allowing the crystal to be easily removed. Due to the choice of light alloy or plastic components, this tool system is light, and easy to handle. It is very inexpensive, requires no adjustment owing to the assortment of bell-chucks which are each very low-priced and it is both very simple and quick to exchange one bell-chuck for another.

What is claimed is:

1. A tool system for the extraction of a watch bezel, including:

(a) a holding body;

(b) a bell-chuck, arranged to rest on the periphery of a bezel mounted on a middle part of a watch;

(c) an expansion mechanism or a retraction mechanism, operable on the bell-chuck, wherein the holding body is arranged to cooperate with the expansion mechanism or the retraction mechanism; and (d) thrust means, mounted coaxially inside the bell-chuck and arranged to rest on a crystal driven into the middle part, wherein the thrust means exerts a sufficient thrust force on the crystal to displace the bell-chuck relative to the crystal, wherein the thrust means includes a support member that is arranged to press on a middle part of the crystal and includes a recess towards the centre thereof, so as to rest on a circle of larger diameter of the crystal in order to best distribute the thrust force, wherein the holding body includes an internal thread that cooperates with the threaded art of an arbour, wherein the support member is mounted at a first end of the arbour and wherein a second end of the arbour has an operating handle for exerting the thrust force on the crystal.

2. The tool system according to claim 1, wherein the expansion or retraction mechanism includes a part operably connected for the longitudinal handling of a bell, wherein the bell cooperates via an inner profile thereof with a peripheral surface of the bell-chuck to open or close the bell-chuck.

3. The tool system according to claim 2, wherein the part operably connected for the longitudinal handling of the bell results from the cooperation between an external thread of an external insert integral with the holding body and an internal thread of an internal insert integral with the bell.

4. The tool system according to claim 2, wherein the part operably connected for the longitudinal handling of the bell results from the cooperation between an external thread of the holding body and an internal thread of the bell.

5. The tool system according to claim 2, wherein the inner profile is conical and arranged to cooperate with an external peripheral surface having the same conicity as the bell-chuck.

6. The unit formed by the tool system according to claim 2, wherein the bell-chuck includes a coaxial head and foot about an axis, wherein the head is arranged or devised to receive the bezel in a housing, wherein the housing comprises a front support surface perpendicular to the axis, and a lateral holding surface arranged to rest on the periphery of the bezel, wherein the bell-chuck includes one or several slots which allow the head to expand or retract radially according to the force applied by the inner profile of the bell on an external peripheral surface of the head, wherein the peripheral surface has a tapered profile, the radius thereof increasing with the distance travelled along the axis, and wherein the bell-chuck further includes, at a front end, by the housing, coplanar lips arranged to separate the bezel from the middle part.

7. The unit formed by the tool system according to claim 6, wherein the lips are pointed on the side of the axis and are concentric.

8. The unit formed by the tool system according to claim 6, wherein the bell-chuck is devised for a precise watch model, and wherein the sizing of the housing both allows the bezel to be frontally supported on the support surface and the lips to be precisely positioned opposite the join between the bezel and the middle part of the watch.

9. The unit formed by the tool system according to claim 6, wherein the bell-chuck is interchangeable, and that the foot includes guide means arranged for cooperating with complementary guide means comprised in the holding body, the foot further including stop means that, which is arranged to cooperate with complementary stop means comprised in the holding body, for axially immobilising the bell-chuck relative to the holding body.

10. The unit formed by a tool system according to claim 9, wherein the complementary stop means comprises pins that can move substantially radially in housings in the holding body and that are manoeuvrable via pivoting parts jointed on pivots on the holding body and moveable inside housings in the holding body, and wherein the pins are returned to the retracted position by springs acting on the pivoting parts.

11. The tool system according to claim 2, wherein the bell-chuck includes a head and foot coaxial about an axis, wherein the head is arranged or devised to receive the bezel in a housing that includes a front support surface perpendicular to said axis, and a lateral holding surface arranged to rest on the periphery of said bezel, wherein the bell-chuck includes one or several slots, that allow the head to expand or retract radially, according to the force applied by the inner profile of the bell on an external peripheral surface of the head, wherein the peripheral surface has a tapered profile with a radius that increases with the distance travelled along the axis, and wherein the bell-chuck further includes, at a front end by the housing, coplanar lips arranged for separating the bezel from the middle part.

12. The tool system according to claim 1, wherein the support member is interchangeable so as to adapt to the shape or size of the crystal, and wherein the support member is securable by a pin, screw or similar element, to the end of an arbour of the thrust means.

* * * * *